US005707057A

United States Patent [19]

Oyama

[11] Patent Number: 5,707,057

[45] Date of Patent: Jan. 13, 1998

[54] SHEET FEEDING DEVICE

[75] Inventor: Koichi Oyama, Tokyo, Japan

[73] Assignee: Riso Kagaku Corporation, Tokyo, Japan

[21] Appl. No.: 550,865

[22] Filed: Oct. 31, 1995

[30] Foreign Application Priority Data

Nov. 17, 1994 [JP] Japan ..... HEI.6-283379

[51] Int. Cl.[6] ..... B65H 3/52

[52] U.S. Cl. ..... 271/121

[58] Field of Search ..... 271/121, 124, 271/125

[56] References Cited

FOREIGN PATENT DOCUMENTS

| | | | |
|---|---|---|---|
| 63-282032 | 11/1988 | Japan | 271/121 |
| 289731 | 3/1990 | Japan | 271/121 |
| 2163220 | 6/1990 | Japan | 271/121 |
| 3102019 | 4/1991 | Japan | 271/121 |
| 485227 | 3/1992 | Japan | 271/121 |
| 4350034 | 12/1992 | Japan | 271/121 |
| 6-227701 | 8/1994 | Japan | B65H 5/06 |

*Primary Examiner*—David H. Bollinger

*Attorney, Agent, or Firm*—Sughrue, Mion, Zinn, Macpeak & Seas, PLLC

[57] ABSTRACT

A sheet feeding device comprises: a sheet feeding roll having a central axis, the sheet feeding roll being rotatable around the central axis thereof; a sheet separating plate abutted against the sheet feeding roll; and a roller located downstream of the sheet separating plate as viewed in a sheet conveying direction, and abutted against the sheet feeding roll, wherein the roller is turned by the sheet feeding roll.

9 Claims, 4 Drawing Sheets

SHEET FEEDING DEVICE

BACKGROUND OF THE INVENTION

1. Field of the Invention

This invention relates to a sheet feeding device which separates one sheet from a stack of sheets at a time, and forwards it.

2. Description of the Related Art

A sheet feeding device is known in the art which has a sheet feeding roll which is rotated, and a sheet separating board which is pushed against the sheet feeding roll with a predetermined strength, to separate one sheet from a stack of sheets at a time and send it out.

The above-described conventional sheet feeding device suffers from the following difficulty: When the sheet separated from the stack of sheets is conveyed along the sheet separating board by the sheet feeding roll, it is liable to slip on the sheet feeding roll. Hence, it is difficult that the sheet feeding device is applied, for instance, to original conveying means in an original reading device.

SUMMARY OF THE INVENTION

In view of the foregoing, an object of the invention is to provide a sheet feeding device which, being free from the difficulty that a sheet separated from a stack of sheet slips on the sheet feeding roll, is able to positively separate one sheet from a stack of sheets at a time and send it out.

The foregoing object of the invention has been achieved by the provision of a sheet feeding device which, according to the invention, comprises: a sheet feeding roll having a central axis, the sheet feeding roll being rotatable around the central axis thereof; a sheet separating plate abutted against the sheet feeding roll; and a roller located downstream of the sheet separating plate as viewed in a sheet conveying direction, and abutted against the sheet feeding roll, wherein the roller is turned by the sheet feeding roll.

In the sheet feeding device, sheet pressing means for pressing a sheet against the sheet feeding roll is provided upstream of the sheet separating plate as viewed in the sheet conveying direction.

In the sheet feeding device, the sheets stacked therein are pushed against the sheet feeding roll by the sheet pressing means. The sheets thus pushed are forwarded one at a time being handled by the sheet feeding roll and the sheet separating plate. The sheet thus forwarded is clamped by the sheet feeding roll and the roller driven by the sheet feeding roll, thus being smoothly sent out.

DETAILED DESCRIPTION OF THE PREFERRED EMBODIMENTS

A sheet feeding device, which constitutes a first embodiment of the invention, will be described with reference to FIGS. 1 and 2.

In the device 1, a sheet feeding roll 2 is rotatably supported by a supporting mechanism (not shown); that is, it is rotatable around its central axis. More specifically, the sheet feeding roll 2 is turned counterclockwise (in FIG. 1) by driving means (not shown).

Figure 1:
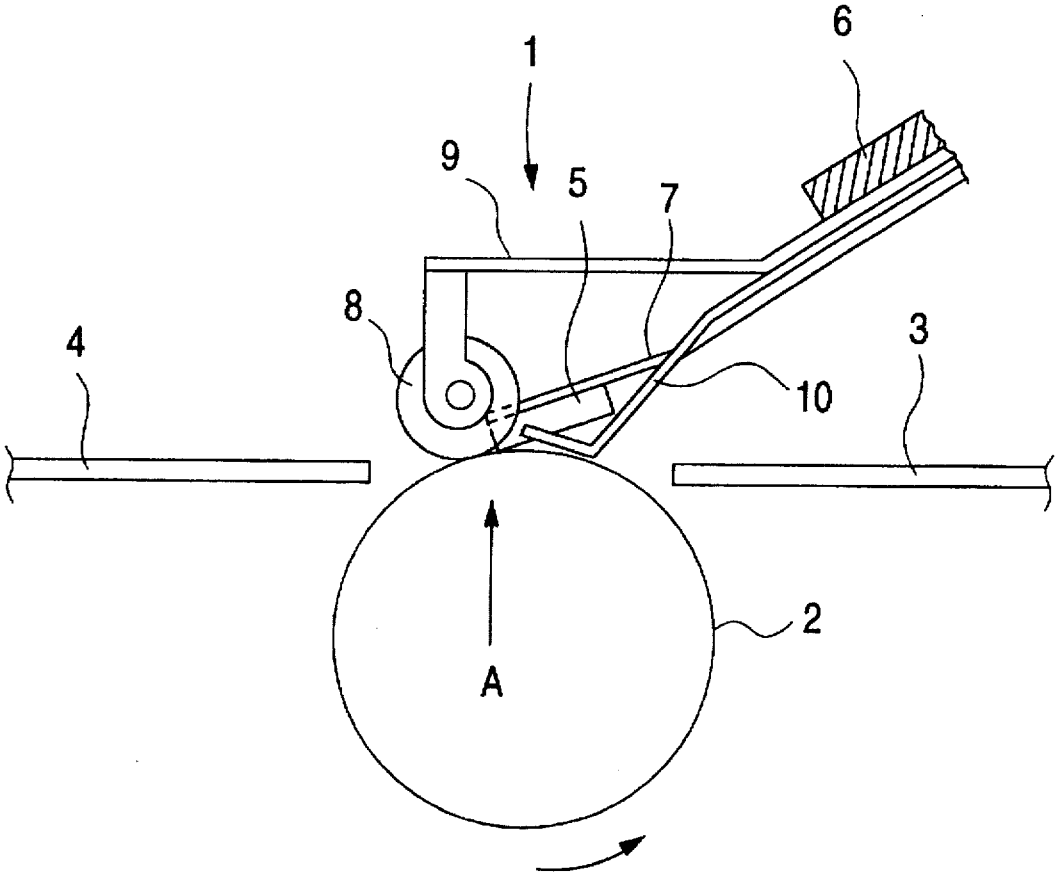
FIG. 1 is a side view of a sheet feeding device, which constitutes a first embodiment of the invention.
Figure 2:
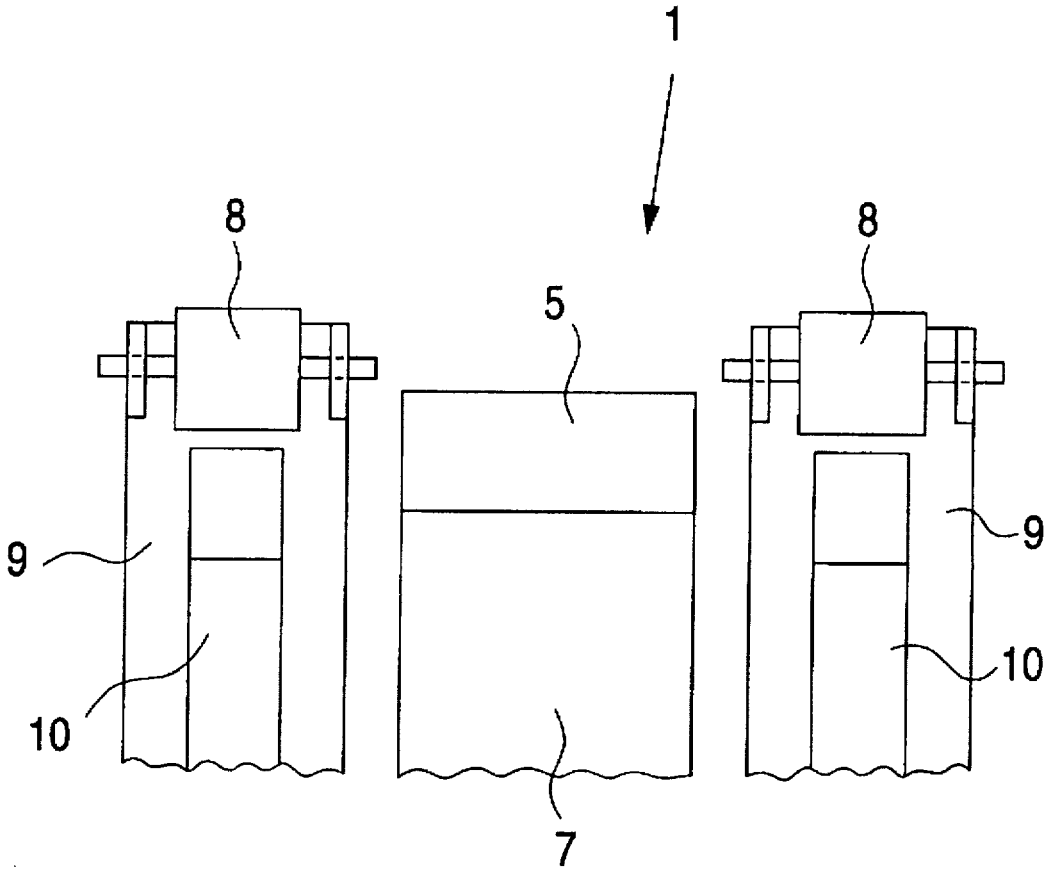
FIG. 2 is a partial view of the device as viewed in the direction of the arrow A in FIG. 1.

As shown in FIG. 1, a sheet placing table 3, on which sheets to be forwarded by the sheet feeding roll 2 are stacked, is provided on the right side of the sheet feeding roll 2; and a sheet receiving table 4, on which sheets forwarded by the sheet feeding roll 2 are placed, is provided on the left side of the sheet feeding roll 2, in such a manner that the surface of the sheet placing table 3 is flush with that of the sheet receiving table 4, and the top portion of the sheet feeding roll 2 appears between those tables 3 and 4.

A sheet separating plate 5 is pushed against the surface of the top portion of the sheet feeding roll 2 which appears between the sheet placing table 3 and the sheet receiving table 4. The lower surface of the sheet separating plate 5 forms an acute angle with the surface of the sheet placing table 3, and the lower surface of the separating plate 5 faces the sheet placing table 3. The sheet separating plate 5 is attached through a leaf spring 7 to a supporting base board 6 which is one of the structural members of the sheet feeding device.

A roller 8 is provided downstream of the sheet separating plate 5 as viewed in the direction of conveyance of the sheet (hereinafter referred to as "a sheet conveying direction" or "a sheet forwarding direction", when applicable). More specifically, in the embodiment, a pair of rollers 8 are provided on both sides of the sheet separating plate 5, respectively, and are abutted against the sheet feeding roll 2. The contact regions of the rollers 8 and the sheet feeding roll 2 are located near the contact region of the sheet separating plate 5 and the sheet feeding roll 2, and are closer to the sheet receiving table 4 than the contact region of the sheet separating plate 5 and the sheet feeding roll 2. The rollers 8 are mounted through arms 9 on the supporting base board 6. The rollers 8 are held in contact with the cylindrical surface of the sheet feeding roll 2 by the elastic forces of those arms 9, so that they are driven by the sheet feeding roll 2.

Sheet pressing means, namely, a pair of winding angular springs 10 are provided upstream of the sheet separating plate 5 as viewed in the sheet forwarding direction in such a manner that they are elastically in contact with the sheet feeding roll 2. The contact region of each of the winding angular springs 10 and the sheet feeding roll 2 is located near the contact region of the sheet separating plate 5 and the sheet feeding roll 2, and is closer to the sheet placing table 3 than the contact region of the sheet separating plate 5 and the sheet feeding roll 2. The winding angular springs 10 are leaf springs which are secured to the supporting base board 6. The front end portion of each of the springs 10 is bent to form an obtuse angle. The bending line along which the front end portion of the spring 10 is thus bent, is elastically brought into contact with the cylindrical surface of the sheet feeding roll 2. When the sheets are stacked on the sheet placing table 3, and then pushed towards the winding angular springs 10, those sheets are urged downwardly by the springs 10, thus being pushed against the sheet feeding roll 2.

In the sheet feeding device designed as described above, a plurality of sheets are stacked on the sheet placing table 3, and then pushed towards the spring 10, so that those sheets are urged downwardly by the spring 10; that is, they are held by the spring 10 with the lowermost of the sheets in contact with the sheet feeding roll 2. When, under this condition, the sheet feeding roll 2 is turned, friction is produced between the roll 2 and the lowermost sheet on the latter 2, so that the sheet is moved towards the sheet separating plate 5.

Even when a plurality of sheets are forwarded, the sheet separating plates and the sheet feeding roll 2 cooperate with each other to let only one sheet pass by the sheet separating plate 5.

The one sheet thus passed by the sheet separating plate 5, being clamped by the rollers 8 and the sheet feeding roll 2, is forwarded smoothly onto the sheet receiving table 4. Therefore, the sheet clamped by the rollers 8 and the sheet feeding roll 2 does not slip thereon.

Another sheet feeding device, which constitutes a second embodiment of the invention, will be described with reference to FIGS. 3 and 4.

Figure 3:
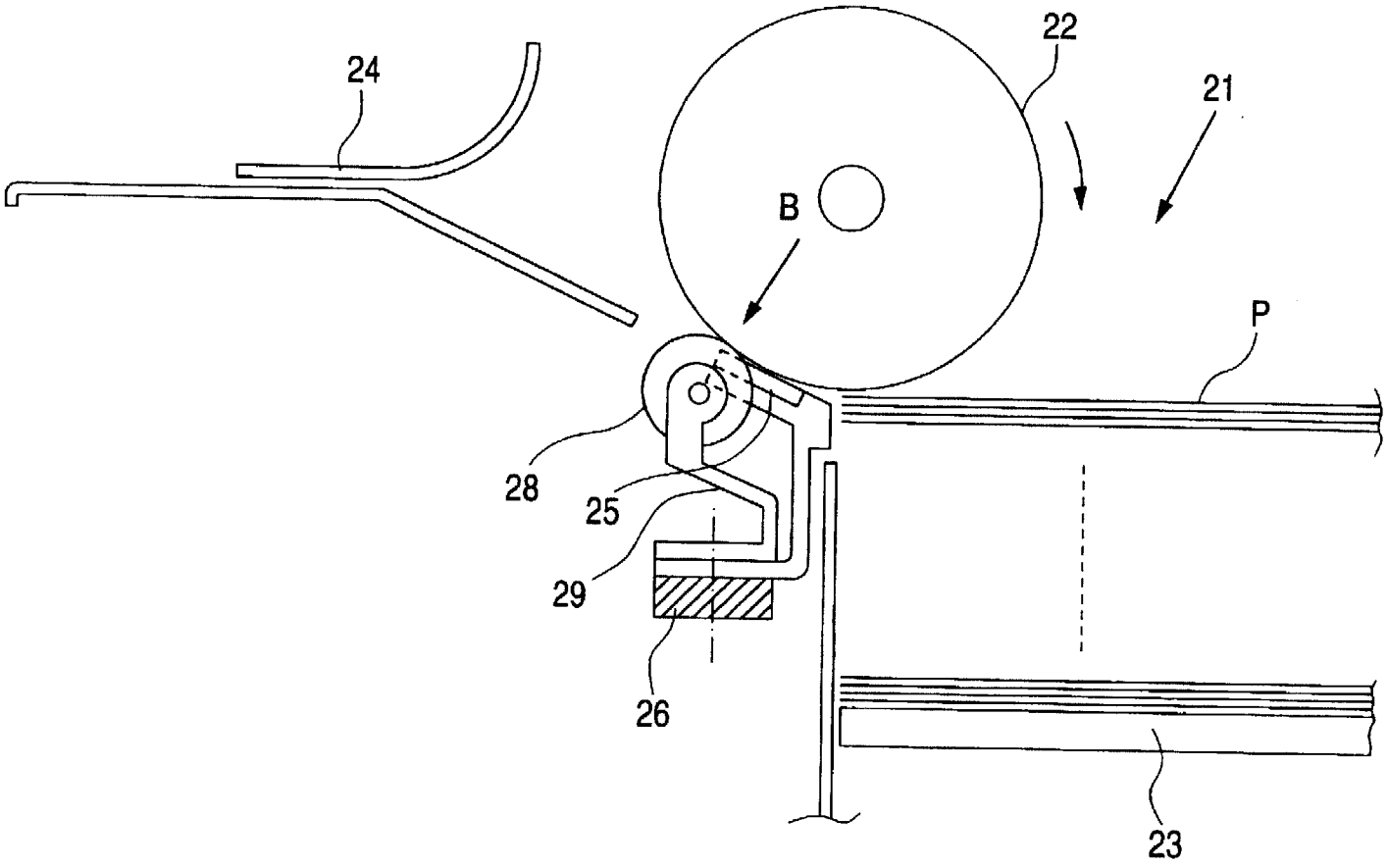
FIG. 3 is a side view of another sheet feeding device, which constitutes a second embodiment of the invention.
Figure 4:
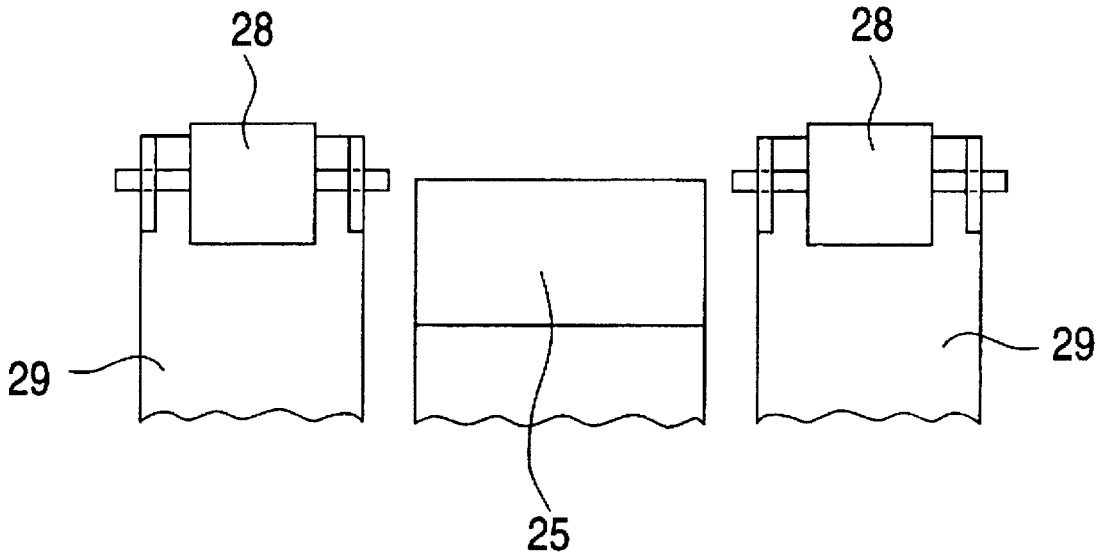
FIG. 4 is a partial view of the device as viewed in the direction of the arrow B in FIG. 3.

The sheet feeding device is indicated generally at 21 in FIGS. 3 and 4. The device 21 has a sheet feeding roll 22 which is supported by a Supporting mechanism (not shown) in such a manner that it is rotatable around its central axis. More specifically, the sheet feeding roll 22 is turned clockwise (in FIG. 3) by drive means (not shown).

As shown in FIG. 3, a sheet feeding table 23, on which sheets to be fed are placed, is provided on the right side of the sheet feeding roll 22 in such a manner that it is movable vertically. In the sheet feeding operation, the sheet feeding table 23 moves a stack of sheets P upwardly to push them against the sheet feeding roll 22. That is, the sheet feeding table 23 serves as sheet pressing means for moving a stack of sheet P to push them against the sheet feeding roll 22.

Pressure control means (not shown) controls the sheet feeding table 23 so that the latter 23 pushes the stack of sheet P against the sheet feeding roll 22 under a constant pressure at all times. The pressure control means may be so designed that the distance between the sheet feeding roll 22 and the surface of the sheet is detected, and the sheet feeding table 23 is moved vertically so that the distance thus detected be a predetermined value; or it may be so designed that a pressure applied to the upper surface of the sheet feeding table 23 is directly detected, and the sheet feeding table 23 is moved vertically so that the pressure thus detected be a predetermined value. The uppermost of the sheets P is brought into contact with the bottom of the sheet feeding roll 22. As shown in FIG. 3, a sheet conveying path 24 along which a sheet forwarded by the sheet feeding roll 22 is moved, is provided on the left side of the sheet feeding roll 22.

A sheet separating plate 25 is held abutted against the sheet feeding roll 22. The contact region of the sheet separating plate 25 and the sheet feeding roll 22 is near the contact region of the sheet feeding roll 22 and the stack of sheets P on the sheet feeding table 23, and is located downstream of the latter contact region as viewed in the sheet forwarding direction. The sheet separating plate 25 is secured to a supporting base board 26 which is one of the structural members of the sheet feeding device, and is elastically urged towards the sheet feeding roll 22.

A pair of rollers 28 are provided downstream of the sheet separating plate 25 as viewed in the sheet conveying direction. More specifically, those rollers 28 are provided on both sides of the sheet separating plate 25, respectively. The contact regions of the rollers 28 and the sheet feeding roll 22 are located near the contact region of the sheet separating plate 25 and the sheet feeding roll 22, and are closer to the sheet conveying path 24 than the contact region of the sheet separating plate 25 and the sheet feeding roll 22. The rollers 28 are mounted through arms 29 on the supporting base board 26. The rollers 28 are held in contact with the cylindrical surface of the sheet feeding roll 22 by the elastic forces of those arms 29, so that they are driven by the sheet feeding roll 22.

In the sheet feeding device thus organized, a plurality of sheets P are stacked on the sheet feeding table 23, and then the sheet feeding table 23 is moved upwardly so that the sheets P are pushed against the sheet feeding roll 22 from below; that is, the uppermost of the sheets P is brought into contact with the sheet feeding roll 22. When, under this condition, the sheet feeding roll 22 is turned, friction is produced between the roll 22 and the uppermost sheet under the roll 22, so that the sheet is moved towards the sheet separating plate 25.

Even when a plurality of sheets are forwarded, the sheet separating plate and the sheet feeding roll 22 cooperate with each other to let only one sheet pass by the sheet separating plate 25.

The one sheet thus passed by the sheet separating plate 25, being clamped by the rollers 28 and the sheet feeding roll 22, is moved smoothly to the sheet conveying path 24. Therefore, the sheet clamped by the rollers 28 and the sheet feeding roll 22 does not slip thereon.

As the sheets are conveyed one by one in the above-described manner, the number of sheets P on the sheet feeding table 23 is decreased. However, since the sheet feeding table 23 is moved upwardly in the above-described way, the sheets P on the sheet feeding table 23 is held suitably pushed against the sheet feeding roll 22 at all times.

With the sheet feeding device according to the invention, each sheet taken out of the stack of sheets is positively prevented from slipping on the sheet feeding roll; that is, the sheets can be forwarded positively one at a time. Hence, in the case where the sheet feeding device of the invention is applied to original conveying means in an original reading device, the original reading operation is smoothly carried out; that is, the original is positively prevented from being shifted during conveyance, so that the resultant image is high in picture quality. In addition, in the sheet feeding device, the friction produced between the sheet feeding roll and the sheet is relatively low, and therefore the quantity of paper powder formed thereby is also small.

What is claimed is:

1. A sheet feeding device comprising:

a sheet feeding roll having a central axis, said sheet feeding roll being rotatable around said central axis thereof;

a sheet separating plate abutted against said sheet feeding roll; and a roller located downstream of said sheet separating plate as viewed in a sheet conveying direction, so that an upstream portion of said roller is at least partially laterally aligned with a downstream portion of said separating plate such that the contact region portion of said roller is immediately adjacent to contact region portion of said plate and abutted against said sheet feeding roll, wherein said roller is turned by said sheet feeding roll.

2. A sheet feeding device according to claim 1, further comprising:

sheet pressing means provided upstream of said sheet separating plate as viewed in the sheet conveying direction, for pressing a sheet against said sheet feeding roll.

3. A sheet feeding device according to claim 1, wherein a lower surface of said sheet separating plate forms an acute angle with the surface of stacked sheets conveyed by said sheet feeding roller and said lower surface of said sheet separating plate faces the stack.

4. A sheet feeding device comprising:

a sheet feeding roll having a central axis, said sheet feeding roll being rotatable around said central axis thereof;

a sheet separating plate abutted against said sheet feeding roll; and a pair of rollers located downstream of said sheet separating plate as viewed in a sheet conveying direction, so that an upstream portion of said rollers is at least partially laterally aligned with a downstream portion of said separating plate such that the contact region portion of said rollers is immediately adjacent to contact region portion of said plate, said rollers being juxtaposed at both sides of said sheet separating plate to have a common axis and being abutted against said sheet feeding roll, wherein said rollers are turned by said sheet feeding roll.

5. A sheet feeding device according to claim 4, further comprising:

sheet pressing means provided upstream of said sheet separating plate as viewed in the sheet conveying direction, for pressing a sheet against said sheet feeding roll.

6. A sheet feeding device according to claim 5, wherein said sheet pressing means comprising:

a pair of winding angular springs positioned upstream of said respective rollers and substantially aligned therewith.

7. A sheet feeding device according to claim 6, wherein said pair of angular winding springs are bent at a front portion to form an obtuse angle and said front end portions are elastically brought into contact with the cylindrical surface of said sheet feeding roll.

8. A sheet feeding device according to claim 4, further comprises:

a base;

a leaf spring having two opposite portions, one portion secured to said base, the other portion to which said sheet separating plate is attached; and a pair of arms secured to said base, said arms rotatably supporting said respective rollers.

9. A sheet feeding device according to claim 4, wherein an upper surface of said sheet separating plate forms an acute angle with the surface of stacked sheets conveyed by said sheet feeding roller and said upper surface of said sheet separating plate faces the stack.

* * * * *